US005624716A

United States Patent [19]

Shulman

[11] Patent Number: 5,624,716

[45] Date of Patent: Apr. 29, 1997

[54] METHOD OF SEALING ANODIZED ALUMINUM

[75] Inventor: Garson P. Shulman, Torrance, Calif.

[73] Assignee: Alumitec Products Corp., Sierra Madre, Calif.

[21] Appl. No.: 418,311

[22] Filed: Apr. 7, 1995

Related U.S. Application Data

[63] Continuation-in-part of Ser. No. 367,555, Feb. 21, 1995, which is a continuation of Ser. No. 146,533, Nov. 2, 1993, abandoned.

[51] Int. Cl.[6] ..... B05D 1/18

[52] U.S. Cl. ..... 427/430.1; 427/434.3; 118/402; 118/423

[58] Field of Search ..... 427/430.1, 434.3; 148/275, 272, 251, 252, 274, 276, 277; 118/402, 423

[56] References Cited

U.S. PATENT DOCUMENTS

| | | | |
|---|---|---|---|
| 3,510,411 | 5/1970 | Kramer et al. | 205/201 |
| 3,867,173 | 2/1975 | Putzer | 427/434.3 |
| 4,091,126 | 5/1978 | Hidan | 427/434.3 |
| 5,156,888 | 10/1992 | Haubs et al. | 427/434.3 |
| 5,169,458 | 12/1992 | Shulman | 148/248 |
| 5,226,976 | 7/1993 | Carlson | 148/257 |
| 5,362,569 | 11/1994 | Bauman | 428/472.2 |

*Primary Examiner*—Shrive Beck
*Assistant Examiner*—David M. Maiorana
*Attorney, Agent, or Firm*—Louis J. Bachand

[57] ABSTRACT

Structures having anodized aluminum surfaces are coated with corrosion blocking fatty acid coatings by dipping successive portions of the structures progressively through a layer of fatty acid disposed on a liquid in a tank and into the liquid which bodily receives the structure, to achieve effective sealing coating without the use of large volumes of fatty acid.

16 Claims, 1 Drawing Sheet

METHOD OF SEALING ANODIZED ALUMINUM

REFERENCE TO RELATED APPLICATION

This application is a continuation in part of my copending application Ser. No. 08/367,555, filed Feb. 21, 1995, which is in turn a continuation of application Ser. No. 08/146,533, filed Nov. 2, 1993, now abandoned, the disclosure of which is incorporated herein by this reference.

TECHNICAL FIELD

This application has to do with improved methods and apparatus for sealing anodized aluminum with fatty acids against corrosion and for increased fatigue strength. In particular, the invention relates to improvements in application of sealing coats of fatty acid compositions onto anodized aluminum to use less of the fatty acid composition, to minimize contamination of the fatty acid composition with detritus from the anodized aluminum, to provide for ready withdrawal of any contaminants without reprocessing the fatty acid composition, to minimize the generation of environmentally problematical waste streams, and to enable the recirculation and purifying treatment of any contaminated by-products with minimal loss in processing efficiency.

BACKGROUND OF THE INVENTION

Anodized aluminum is useful in myriad products including importantly aircraft. Corrosion of anodized aluminum may occur where there are pores through the anodize layer to the aluminum base material. Such routes may be closed with a fatty acid. In U.S. Pat. No. 3,510,411 to Kramer et al materials including aliphatic acids of more than 5 carbon atoms were used to impregnate anodized aluminum and aluminum alloys to reduce corrosion and increase fatigue strength. Kramer et al disclosed a process for the impregnation which included lowering the viscosity of the acid by reducing it to a molten condition by application of substantial heat. This high heat-dependent process may result in oxidation of the fatty acid particularly over time, and is cumbersome and quite costly for processing of large or complex shapes because of the need to successively create or continually keep molten a great bath of fatty acid. In U.S. Pat. No. 5,169,458 to Shulman a low temperature process for impregnating anodized aluminum avoiding the problems of Kramer et al was disclosed involving the use of more or less solvent to lower the viscosity of the fatty acid and achieve needed liquidity without use of undue temperatures. In U.S. Pat. No. 5,362,569 to Bauman fatty acid compositions containing heterocyclic aromatic azoles are applied to anodized aluminum surfaces as solutions in alcohol. In my above-mentioned copending application, assigned to the same assignee as this application, the use of solvent free fatty acids which are liquid at application temperatures, such as isostearic acid for forming sealing coatings on anodized aluminum with or without use of azoles is taught.

A different type of conversion coated metal surface protective scheme which does not employ fatty acids is described in U.S. Pat. No. 5,226,976 to Carlson.

SUMMARY OF THE INVENTION

It is accordingly an object of the invention to provide a corrosion resistance improving sealing coating for anodized metals including aluminum. It is a further object to effect such sealing coatings with minimum use of fatty acids.

Another object is to carry a fatty acid surface sealing composition in position to entirely coat even large and complex shaped objects and to avoid the use of equivalent volumes of fatty acid. Yet another object is to employ a relatively scant amount of fatty acid sealing coating composition but positioned so as to differentially immerse one and another portion of the structure part selectively and in sequence so that the entire part is finally immersed albeit a small portion at a time by the use of a bath which has less depth than the vertical extent of the part. A still further object is to effect sealing coating of fatty acids on anodized aluminum surfaces using liquid fatty acids free of organic and inorganic solvents and diluents, such as normally liquid fatty acid, e.g. isostearic acid and branched chain isostearic acids or oleic acid which are liquid at application temperatures, e.g. typically ambient temperatures between 15° and 40° C.

These and other objects of the invention to become apparent hereinafter are realized in the method of sealing anodized aluminum surfaces of a structure against corrosion including dipping the structure into a tank of liquid ineffective to seal the structure surfaces, and maintaining a coating effective layer of fatty acid atop the tank of liquid in contacting relation with the structure surfaces during dipping of the structure into the tank, whereby the structure surfaces are coated with fatty acid.

In this and like embodiments, typically, the liquid comprises water and the fatty acid comprises isostearic acid.

Further, typically, the tank contains a body of liquid large enough to bodily receive the entirety of the vertical and horizontal extents of the structure, the fatty acid coating layer being of a depth insufficient to bodily receive the entirety of the structure, and the structure is coated a portion of its vertical extent at a time by the coating fatty acid layer in passage into the tank liquid.

In a further embodiment the invention provides the method of sealing an anodized aluminum structure surface against corrosion, including application of a coating fatty acid to the surface a portion at a time by successively passing the surface twice through a coating fatty acid layer disposed on a nonfatty acid liquid, such as water, in fatty acid coating relation, and passing the structure surface through the nonfatty acid liquid between the successive passes through the coating fatty acid.

In this and like embodiments, the structure is passed in and out of the tank through the coating fatty acid layer and into the liquid, there is further included recirculating the liquid to and from the tank with the coating fatty acid layer in place, separating contaminants from the liquid in the course of recirculating the liquid, adding make-up chemicals to the liquid in the course of recirculating the liquid, selecting as the coating fatty acid a fatty acid having from 10 to 24 carbon atoms, maintaining the fatty acid free of solvent and diluents, selecting as the fatty acid isostearic acid, coating the fatty acid on the surface in surface sealing amounts, and selecting as the aluminum structure surface an aluminum surface having an anodize layer of 0.2 to 5.0 mils thickness.

The invention further comprises apparatus for the application of sealing amounts of coating fatty acids to the anodized surfaces of an aluminum structure, the apparatus comprising a dip tank, a quantity of non-coating-fatty acid liquid in the tank, and a layer of coating fatty acid disposed atop the liquid in structure surface coating relation during structure surface passage into the tank liquid through the coating fatty acid. Typically, the non-coating fatty acid liquid in the tank is sized to bodily receive the structure, the coating acid layer being sized to only partially bodily receive the structure at any one time, the coating acid layer comprises liquid isostearic acid, and the apparatus further includes means to recirculate the liquid to and from the tank.

BRIEF DESCRIPTION OF THE DRAWINGS

The invention will be further described in conjunction with the attached drawing in which:

The single FIGURE is a schematic view of the coating apparatus of the invention.

DESCRIPTION OF THE PREFERRED EMBODIMENTS

Figure 1:
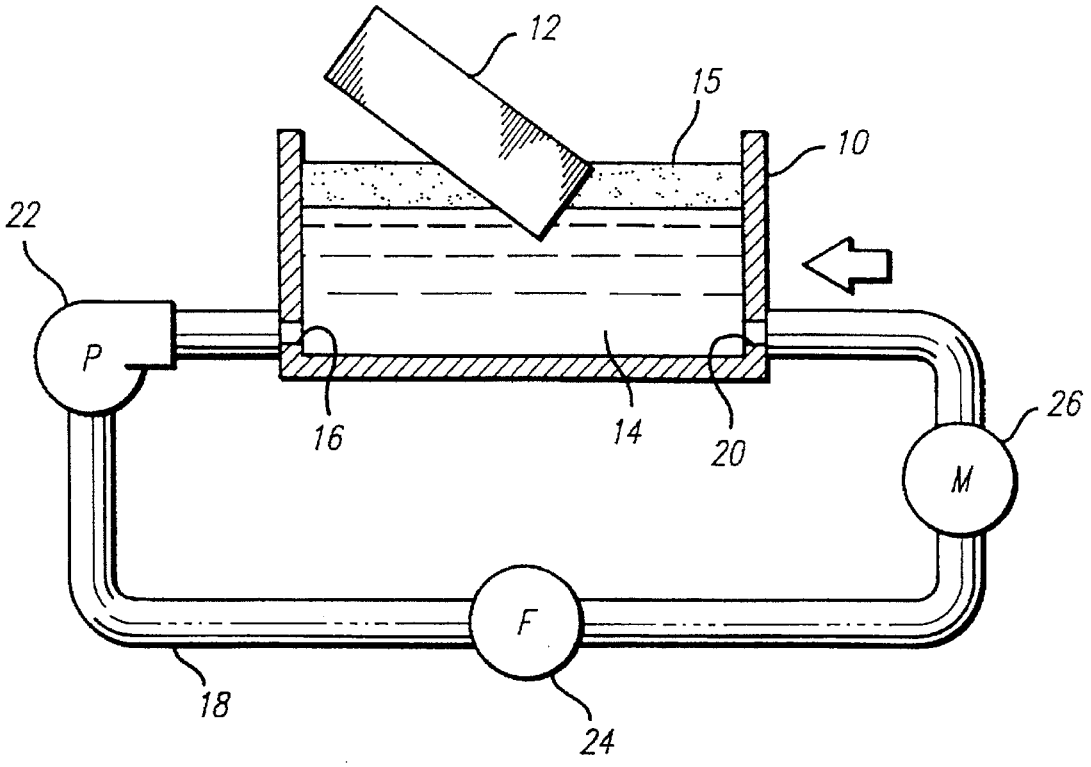

Aluminum herein refers to metals comprising aluminum and minor amounts of alloying ingredients, such as copper, magnesium and manganese. Copper alloys of aluminum containing from 0.2 to 10% by weight copper, and particularly such copper alloys as the Series 1000, Series 2000 and Series 7000 and like alloy series are particularly effectively treated with the invention. Anodized aluminum herein refers to aluminum metal having an oxide layer greater in depth than the native, air oxidized coating typically found on aluminum, which layer ranges in thickness from about 0.2 to about 5 thousandths of an inch.

The need for the invention arises from the fact that during the anodizing process, an array of conical pores is generated in the oxide layer, the cone apex being very near the surface of the metal, separated only by a barrier layer about 2 microns thick, while the base of the cones is on the outer surface. These pores are believed to form from localized resistance heating near the oxide barrier layer of the sulfuric acid of the anodizing bath causing dissolution of the protective oxide barrier layer leaving the aluminum underneath exposed.

Traditionally, sealing of these pores has been conducted in aqueous media, using hot water alone or with dissolved salts such as nickel, cobalt, or magnesium acetates or sodium chromate. This sealing process conducted in a homogeneous phase, causes conversion of boehmite, the aluminum oxyhydroxide initially formed, to aluminum trihydroxide. The trihydroxide occupies a larger volume than the boehmite, the expansion closes the pores.

Recently, an improved sealing process has been described in certain of the foregoing patents to Shulman and Bauman. In the patented process, long chain carboxylic acids are used to fill the pores. The acids also react with the oxide surface to form aluminum soaps. The preferred acids are liquids at ambient temperature, e.g. isostearic acid, including branch chain isostearic acid, or oleic acid. They can be applied by dip or spray techniques, but dipping is preferred because it is less labor intensive. Fatty acid sealants are relatively expensive compared to water or dilute metal salt solutions. Sealing large parts or structures such as aircraft body and wing components in a homogeneous bath requires tanks deep enough to submerge the parts. The same is true for a long or wide rack on which many smaller parts are mounted. Filling such a deep tank requires large amounts of the expensive fatty acid composition sealants, imposing a high initial cost, in spite of the relatively minor amount of sealant actually incorporated in the pores or dragged out on the surface.

The present invention comprises a process for minimizing the amount of fatty acid composition sealant required to fill a dip tank to be used for seal coating anodized aluminum. The invention takes advantage of the fact that the preferred sealing fatty acids are insoluble in water and of less specific gravity than water, so that these fatty acids can be floated on water, establishing a two-phase system wherein the water supports the fatty acid composition in position to be applied to a structure passed through the acid layer atop the water. The great volume of the tank needed to bodily receive the structure to be coated is merely water; the expensive material is kept to a relatively thin layer resting on the water whence it is applied to the structure in the course of passing the structure to and from the tank.

An additional advantage is derived from the invention. In this two-phase method, separation of impurities introduced during sealing and continual purification of the dip tank is effected by flushing the aqueous phase without disturbing the fatty acid sealant phase. The waste water can be discarded, provided it is environmentally benign, so long as replacement water is introduced without lowering the level of the organic phase to that of the drain. A recirculating system incorporating a recirculating pump, a treatment zone having a filter, an ion exchange resin cartridge, and perhaps an adsorbent cartridge (e.g. activated carbon), and a chemical make-up zone located in advance of the return inlet into the tank for adding chemical modifier materials to the tank water, can be used for their usual purposes of treatment of the recirculating water as the water is recirculated between an outlet and an inlet located near the bottom of the tank in the water phase.

Metal fragments from treated parts and metallic salts found in the tank, being heavier than water, will settle to the bottom of the tank, safely distanced from the sealing process at the top of the tank. A frequent cause of sealant contamination is detritus carried to the tank as a result of inadequate rinsing after anodizing of the parts to be sealed which can cause contamination of the sealing bath with the anodizing acid, salts of aluminum or alloying elements, organic anodizing bath additives, or dyes from a coloring process. Build-up of acids can cause some deterioration of the sealant, dyes can affect color of subsequent parts if more than one color is used, and some metals are catalysts for air oxidation. In the invention method, these impurities concentrate in the water phase from which they can be removed without disturbing the sealant phase.

Copper salts are particularly likely to cause oxidation of vegetable oils or their constituent acids. Many aluminum-copper alloys are used in industry. They are the most corrosion-prone alloys, most in need of the corrosion resistance imparted by long chain carboxylic acid sealants. Being able to continuously remove copper salts from the sealant acid containing tank greatly increases the useful life of the fatty acid composition sealant.

In the invention method the use of ion-free water is preferred. Tap water can be used, but the salts it contains would be bound to any ion exchange resin used and would shorten its useful life.

Because anodized aluminum sealing is accomplished almost immediately on contacting the fatty acid, sealing of parts and structures by passing them through an organic layer into water is readily effected by the invention process. The fatty acid layer may be as little as 0.5 inch thick, but it is preferred to use a thicker layer, e.g. 6 to 24 inches thick, depending on the size of the structures and the overall depth of the tank. Structures, or racks of racked parts, to be treated are typically inserted into the tank at speeds of 0.1 to 12 inches per minute, slower speeds being used with thinner layers. Blind holes should be positioned horizontally or vertically facing up, allowing air to escape and sealant to fill the holes.

With reference to the drawing, the single FIGURE depicts the invention apparatus including a tank 10 of suitable dimensions for the task at hand, e.g. 75 feet long, by 20 feet wide by 20 feet deep, for aircraft structures, smaller where less imposing parts are to be treated. Structure 12 supported by means not shown is to be treated by immersion in the tank. Tank 10 is substantially filled with water 14. Floating atop water 14 is a relatively thin layer of fatty acid immiscible with the water and forming a supernatant layer 15 which is the coating material used in the invention. Water 14 is recirculated to and from the tank 10 from outlet 16 through conduit 18 to inlet 20 via pump 22, treatment zone shown as filter 24 having one or more components as above described and a chemical make-up zone 26 where one or more additives and chemical modifiers can be added. Outlet 16 and inlet 20 are well below the acid layer 15 so as to not disturb that layer during recirculation.

EXAMPLES

Example I

A glass dip tank 4×12×24 inches deep is filled with deionized water to a depth of 18 inches. In a series of experiments summarized in the following table, a fatty acid sealant composition comprising a mixture of isostearic acid 99.9%, benzotriazole 0.1% is placed on the surface. The initial thickness of this layer is ⅛ inch. After two sets of 5 panels 3×10×1/16 inches of 2024 aluminum alloy are lowered through the organic layer and bodily into the water and removed, additional sealant is added to a 1 inch thickness, 5 more panels are treated, then the sealant thickness is increased to 5 inches, and 5 more panels are treated. Speed of passage through the sealant composition layer is varied as shown below. The panels are dried by wiping with a soft cloth, and then tested in hot salt spray for 336 hours according to the procedure of ASTM B-117. Results are given in the table.

TABLE

| Thickness of Sealant (inch) | Speed of Immersion (in/min.) | Pits/5 Panels | Result |
|---|---|---|---|
| 0.125 | 0.1 | 0 | pass |
| 0.125 | 12 | many | fail |
| 1.0 | 3 | 0 | pass |
| 5.0 | 12 | 0 | pass |

The TABLE results indicate that at higher immersion (application) speeds, relatively thicker layers of fatty acid composition sealant are desirable to ensure effective coating of the part.

Example II

The tank in Example I is used with a 3 inch layer of oleic acid 99.9%, citric acid 0.1% disposed on 18 inches of deionized water. Five panels are lowered at a rate of 3 inches per minute, removed, dried, and subjected to ASTM B-117 salt spray for 336 hours. No pits are noted.

Example III

The tank in Example I is fitted with recirculating conduit, a recirculating pump, and a treatment vessel containing an ion exchange resin cartridge, the conduit returning to the tank at an inlet about 12 inches above the outlet. A 1 inch layer of isostearic acid is disposed on 18 inches of deionized water containing 0.1% Universal pH Indicator. Five panels are anodized, drained, lightly wiped, and inserted into the tank sideways through the floating acid sealant composition and removed with a sealing coating of the acid. After the sealing operation, the pH of the aqueous phase is below 2, as measured by the indicator. The pump is turned on to flush the tank aqueous phase. After operation of the pump for 30 minutes, the pH rises to 6.

Example IV

Five panels are anodized, thoroughly rinsed, immersed in 5% copper sulfate solution, drained, and allowed to air dry. The recirculating tank system and procedures of Example III is used. Aliquots of the aqueous phase are analyzed by atomic absorption spectrometry and found to contained 20 ppm copper before pumping to flush, and 0.5 ppm after 30 minutes of pumping.

Example V

The procedure of Example IV is followed, except that 5% aluminum sulfate is used as a potential salt contaminant. Before pump flushing the aqueous phase, aluminum concentration is 11 ppm, after 30 minutes of pump flushing, the aluminum concentration is 0.2 ppm.

Example VI

Five panels are anodized, thoroughly rinsed, heated in a red Sanodal dye (Sandoz Chemical Co.) bath at 150° F. for 20 minutes, drained, and allowed to air dry. The cartridge in the treatment zone of the recirculating system is changed to one containing activated charcoal. After sealing, a discoloration was observed in the aqueous phase; after pump flushing for 30 minutes the solution was colorless.

The preferred fatty acid is liquid branched isostearic acid or oleic acid. Other fatty acids having from 5 to 24 carbon atoms which are liquid under application temperatures (typically 15° to 40° C.) and application conditions may be used particularly in combination with branched isostearic acid. Heterocyclic aromatic azoles useful in conjunction with the present process include those taught in U.S. Pat. No. 5,362,569, the disclosure of which is hereby incorporated herein, and particularly benzotriazole.

There is thus provided in accordance with the invention a corrosion resistance improving sealing coating for anodized metals including aluminum, effected with minimum use of fatty acids, in which the fatty acid surface sealing composition is carried in position to entirely coat even large and complex shaped objects while avoiding the use of equivalent volumes of fatty acid by differentially immersing one and another portion of the structure part selectively and in sequence so that the entire part is finally immersed albeit a small portion at a time by the use of an immersion bath tank which has less depth than the vertical extent of the part.

The foregoing objects of the invention are thus met.

I claim:

1. Method of sealing anodized aluminum surfaces of a structure against corrosion including dipping said structure into a tank of liquid, said liquid being ineffective to seal said structure surfaces, and maintaining a coating effective layer of fatty acid atop said tank of liquid in contacting relation with said structure surfaces during dipping of said structure into said tank, whereby said structure surfaces are coated with fatty acid.

2. The method according to claim 1, including selecting water as said liquid.

3. The method according to claim 1, including selecting isostearic acid as said fatty acid.

4. The method according to claim 1, including also said tank containing a body of liquid large enough to bodily receive the entirety of the vertical and horizontal extents of said structure, said fatty acid coating layer being of a depth insufficient to bodily receive the entirety of said structure.

5. The method according to claim 4, including also said coating layer depth being insufficient to bodily receive the entirety of the vertical extent of said structure.

6. The method according to claim 1, in which said structure is coated a portion of its vertical extent at a time by said coating fatty acid layer in passage into said tank liquid.

7. Method of sealing an anodized aluminum structure surface against corrosion including application of a coating fatty acid to said surface a portion at a time by successively passing said surface twice through a coating fatty acid layer disposed on a nonfatty acid liquid to coat said surface with a fatty acid coating, and passing said structure surface through said nonfatty acid liquid between said successive passes through said coating fatty acid.

8. The method according to claim 7, in which said structure is passed in and out of said tank through said coating fatty acid layer and into said liquid.

9. The method according to claim 7, including also recirculating said liquid to and from said tank with said coating fatty acid layer in place.

10. The method according to claim 9, including also separating contaminants from said liquid in the course of recirculating said liquid.

11. The method according to claim 9, including also adding make-up chemicals to said liquid in the course of recirculating said liquid.

12. The method according to claim 7, including selecting as said coating fatty acid a fatty acid having from 10 to 24 carbon atoms.

13. The method according to claim 12, including selecting as said fatty acid a fatty acid free of solvent and diluents.

14. The method according to claim 12, including selecting as said coating fatty acid isostearic acid.

15. The method according to claim 12, in which said coating fatty acid is coated on said surface in an amount sufficient to seal said surface.

16. The method according to claim 12, including selecting as said aluminum surface an aluminum surface having an anodize layer of 0.2 to 5 mils thickness.

* * * * *